United States Patent [19]

Girau

[11] Patent Number: 5,059,215

[45] Date of Patent: Oct. 22, 1991

[54] INFANT RATTLE AND TEETHING KIT

[76] Inventor: Lydia Girau, Urb. Villa Los Santos, Calle 10 S-3, Arecibo, P.R. 00612

[21] Appl. No.: 476,561

[22] Filed: Feb. 6, 1990

[51] Int. Cl.[5] ..... A61J 17/00

[52] U.S. Cl. ..... 606/234; 215/11.1

[58] Field of Search ..... 606/234, 235, 236; 215/11.1

[56] References Cited

U.S. PATENT DOCUMENTS

| | | | |
|---|---|---|---|
| D. 249,161 | 8/1978 | Röhrig | 606/234 |
| 2,665,693 | 1/1954 | Pecora | 606/235 |
| 2,699,785 | 1/1955 | Allen | 606/236 |
| 2,743,727 | 5/1956 | Griesinger | 606/236 |
| 2,825,335 | 3/1958 | Natonek | 606/236 |
| 2,954,030 | 9/1960 | Jozwiak | 606/236 |
| 4,481,949 | 11/1984 | Kisselring et al. | 215/11.1 |
| 4,768,510 | 9/1988 | Leung | 606/234 |

FOREIGN PATENT DOCUMENTS

| | | | |
|---|---|---|---|
| 2037836 | 2/1972 | Fed. Rep. of Germany | 606/236 |
| 024435 | 7/1922 | France | 606/236 |
| 0536196 | 5/1941 | United Kingdom | 606/236 |
| 8603403 | 6/1986 | World Int. Prop. O. | 606/236 |

*Primary Examiner*—C. Fred Rosenbaum
*Assistant Examiner*—William W. Lewis
*Attorney, Agent, or Firm*—Leon Gilden

[57] ABSTRACT

A device is set forth providing an apparatus for soothing an infant for use particularly during a teething period of time. The apparatus includes an elliptical forwardly extending nipple directed forwardly of a concave support base, with a rattle member directed rearwardly thereof. The rattle member may alternatively utilize an internally threaded boss to enable filling of the nipple with various liquids for consumption by an infant, with a rattle threadedly received within an internally threaded boss. The rattle is replaceable by a whistle to provide an audible member to replace the mechanical rattle. An alternative construction utilizes a multi-compartmented nipple provided with discrete chambers associated with discrete fill plugs mounted rearwardly of the support member to provide a selective mixture of foods and medicines and the like for ingestion by the infant.

1 Claim, 4 Drawing Sheets

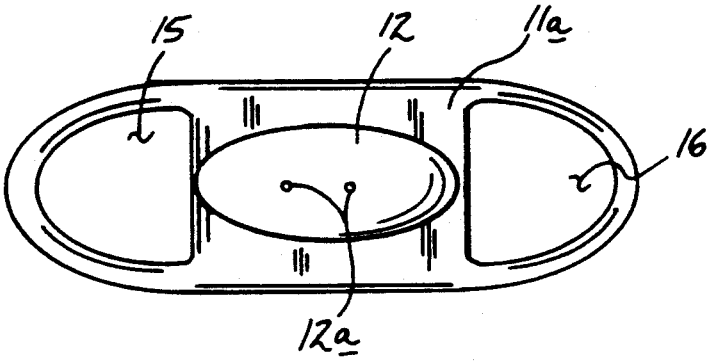
FIG 3
FIG 4
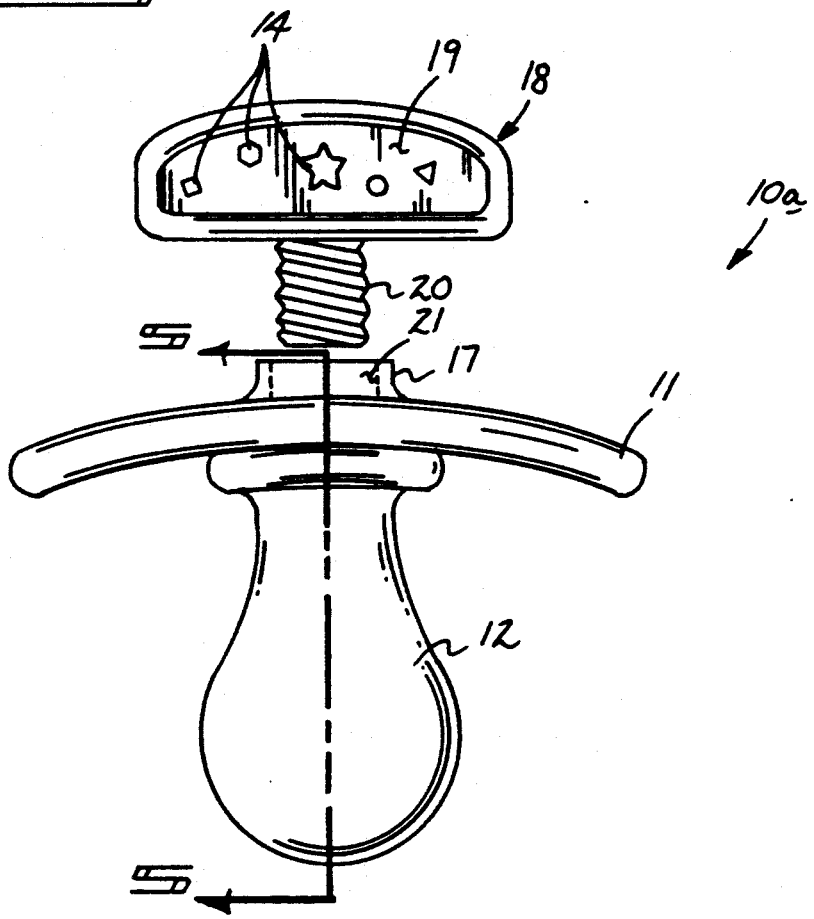

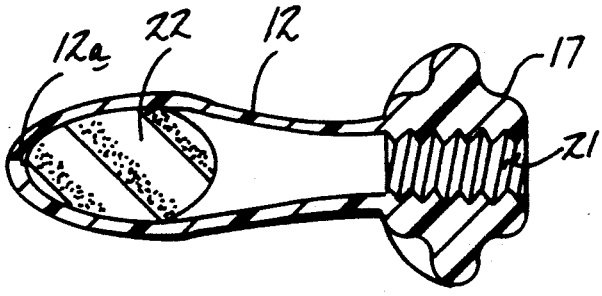
Fig 5
Fig 6
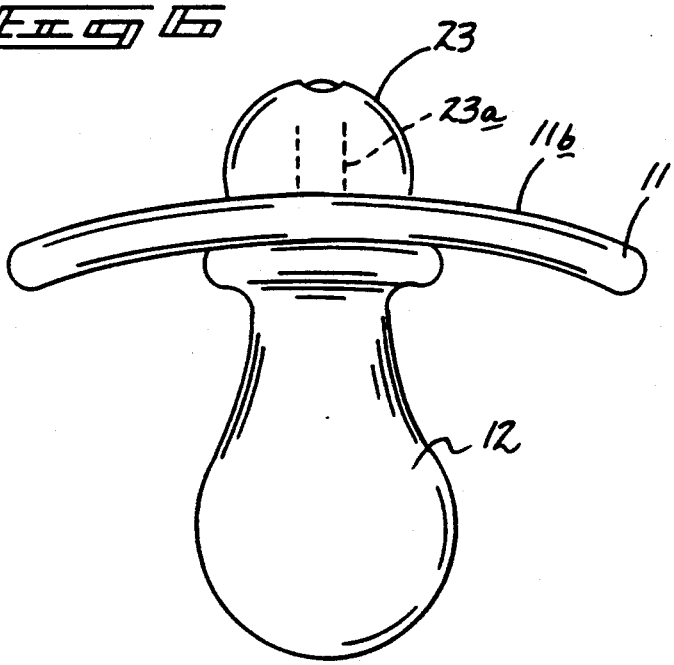

INFANT RATTLE AND TEETHING KIT

BACKGROUND OF THE INVENTION

1. Field of the Invention

The field of invention relates to teething apparatus, and more particularly pertains to a new and improved infant rattle and teething kit wherein the same provides a teething arrangement with selectively replaceable organizations to effect various soothing and nourishing operations regarding the infant.

2. Description of the Prior Art

Infant devices for use during a teething procedure by the infant are known in the prior art, as well as various items to soothe and distract a child during periods of infant stress and upset. Examples of the prior art include Natonek U.S. Pat. No. 2,825,335 wherein a baby rattle is provided with a nipple, and wherein the nipple is mounted to a base provided with a rattle chamber, the rattle chamber includes a rearwardly extending plug that pivotally supports a ring member that is also provided with a rattle chamber therewithin.

Sheridan U.S. Pat. No. 2,549,392 provides a liquid containing rattle wherein the invention provides rattling sounds, as well as providing a visual amusement for an associated infant.

Davis U.S. Pat. No. 2,289,314 sets forth a pictorial rattle, wherein the rattle chamber is provided with a pictorial representation of a predesignated figure to assist in amusing an associated child.

Monaco U.S. Pat. No. 2,532,116 sets forth an infant teething toy provided with a base formed with a hollow chamber directed upwardly to a hollow ring, wherein the chamber is of an undulating configuration to enhance rattling of objects contained within the handle and the communicating ring.

Ware U.S. Pat. No. 954,066 provides an infant teething device formed with a conventional nipple directed to a rearwardly mounted ring and associated tether line.

As such, it may be appreciated that there is a continuing need for a new and improved infant rattle and teething kit wherein the same allows selective use of various rattle and teething constructions to assist in soothing an associated child and in this respect, the present invention substantially fulfills this need.

SUMMARY OF THE INVENTION

In view of the foregoing disadvantages inherent in the known types of infant teething devices now present in the prior art, the present invention provides an infant rattle and teeth kit wherein the same utilizes a rattle construction to enable selective application of various rattle and teething structure to an infant. As such, the general purpose of the present invention, which will be described subsequently in greater detail, is to provide a new and improved infant rattle and teething kit which has all the advantages of the prior art infant teething devices and none of the disadvantages.

To attain this, the present invention includes a device providing an apparatus for soothing an infant for use particularly during a teething period of time, the apparatus includes an elliptical forwardly extending nipple directed forwardly of a concave support base, with a rattle member directed rearwardly thereof. The rattle member may alternatively utilize an internally threaded boss to enable filling of the nipple with various liquids for consumption by an infant, with a rattle threadedly received within an internally threaded boss. The rattle is replaceable by a whistle to provide an audible member to replace the mechanical rattle. An alternative construction utilizes a multi-compartmented nipple provided with discrete chambers associated with discrete fill plugs mounted rearwardly of the support member to provide a selective mixture of foods and medicines and the like for ingestion by the infant.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved infant rattle and teething kit which has all the advantages of the prior art infant teething devices and none of the disadvantages.

It is another object of the present invention to provide a new and improved infant rattle and teething kit which may be easily and efficiently manufactured and marketed.

It is a further object of the present invention to provide a new and improved infant rattle and teething kit which is of a durable and reliable construction.

An even further object of the present invention is to provide a new and improved infant rattle and teething kit which is susceptible of a low cost of manufacture with regard to both materials and labor, and which accordingly is then susceptible of low prices of sale to the consuming public, thereby making such infant rattles and teething kits economically available to the buying public.

Still yet another object of the present invention is to provide a new and improved infant rattle and teething kit which provides in the apparatuses and methods of the prior art some of the advantages thereof, while simultaneously overcoming some of the disadvantages normally associated therewith.

Still another object of the present invention is to provide a new and improved infant rattle and teething kit wherein the same addresses the need to selectively tailor a teething and rattle organization for a particular infants requirement.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic top view taken in elevation the instant invention.

FIG. 4 is an orthographic side view taken in elevation of a modification of the instant invention.

FIG. 5 is an orthographic cross-sectional view taken along the lines 5—5 of FIG. 4 in the direction indicated by the arrows.

FIG. 6 is an orthographic view taken in elevation of a modification of the instant invention utilizing a secured whistle member.

DESCRIPTION OF THE PREFERRED EMBODIMENT

Figure 1:
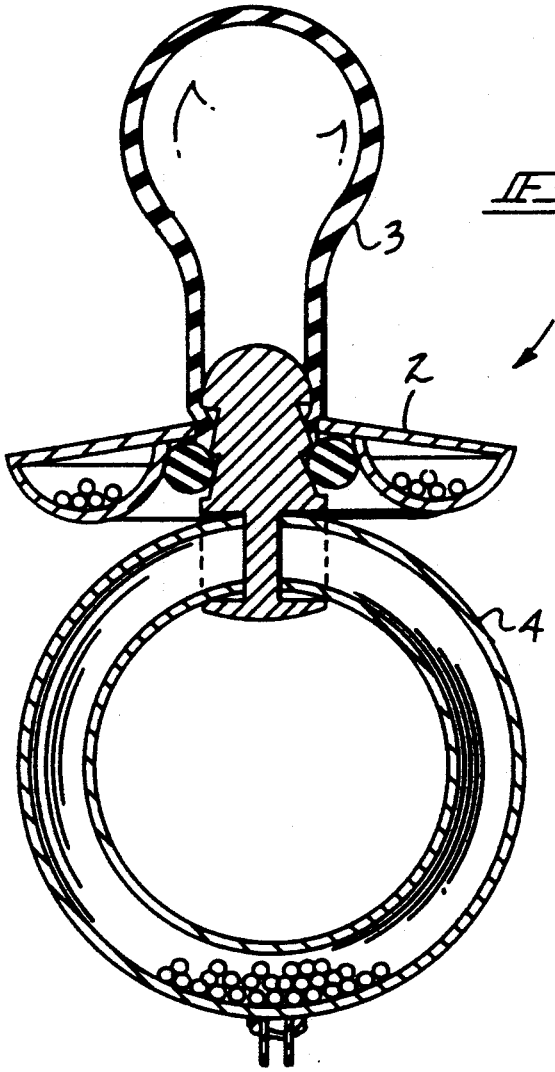
Fig 1 PRIOR ART
FIG. 1 is an orthographic cross-sectional view of a typical prior art rattle and teething apparatus.

With reference now to the drawings, and in particular to FIGS. 1 to 8 thereof, a new and improved infant rattle and teething kit embodying the principles and concepts of the present invention and generally designated by the reference numerals 10, **10*a*, and 10*b*** will be described.

FIG. 1 is illustrative of a typical prior art teething and rattle organization 1 wherein an enclosed nipple member 8 projects coaxially and forwardly of a base support ring 2. The ring 2 includes a hollow chamber formed with rattling portions therewithin. A plug is mounted coaxially of the nipple and the support ring mounting a hollow doughnut-shaped handle, including a further quantity of rattling portions contained therewithin.

More specifically, the infant rattle and teething kit 10 essentially comprises an arcuate base member 11 defined by a concave forward surface **11*a* and a concave rear surface 11*b*. An elliptical pacifier nipple 12 is directed forwardly and orthogonally relative to the concave forward surface 11*a* and projecting medially thereof, with a companion palm accommodating hemisphere 13 projecting rearwardly of the concave rear surface 11*b*. The hemispherical chamber 13 includes a plurality of rattle segments 14 of multi-configured geometric shapes and colorations to amuse and soothe an associated infant utilizing the device. FIG. 3 illustrates the nipple 12 formed with a plurality of spaced vent apertures 12*a* directed through a forward end of the nipple to enable collapse of the nipple in a chewing operation effective by an associated infant. Further, a first and second opening 15 and 16 respectively is directed through the base member 11** to enhance ease of grasping and securement of the device by an infant in its use.

Figure 2:
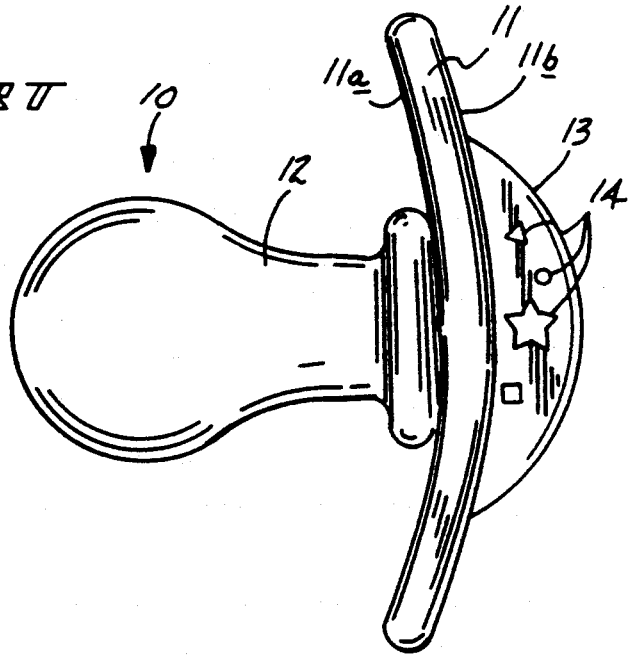
FIG. 2 is an orthographic side view taken in elevation of the instant invention.

FIG. 4 is illustrative of a modified kit member **10*a* wherein the base member 11 includes the elliptical pacifier nipple 12, of a construction as illustrated in FIGS. 2 and 3, but includes a rearwardly directed and integral boss member 17 coaxially aligned with the forwardly projecting nipple 12. The boss member 17 receives a rattle portion 18 formed with a chamber 19 including a plurality of the rattle segments 14 therewithin. A forwardly directed, externally threaded boss 20 is received within an internally threaded fill bore 21 directed coaxially of the boss member 17 to receive the threaded boss 20 therewithin. The bore 21 enables a filling of the nipple chamber 12 with various fluids, medicines and the like for consumption by an infant. Attention to FIG. 5 illustrates the nipple 12 formed with a porous sponge material fixedly mounted within a forward end of the hollow nipple 12 adjacent the forwardly positioned vent apertures 12*a* to slow the consumption of fluids within the nipple chamber positioned rearwardly of the sponge material 22**.

FIG. 6 illustrates a whistle member 28 utilizing a threaded hollow boss **23*a* mounted within the fill bore 21, whereupon a chewing of the nipple 12 by an infant effects an audible whistle sound directed from the whistle 23 as the air is directed through the hollow threaded boss 23*a*** and through the associated whistle.

Figure 7:
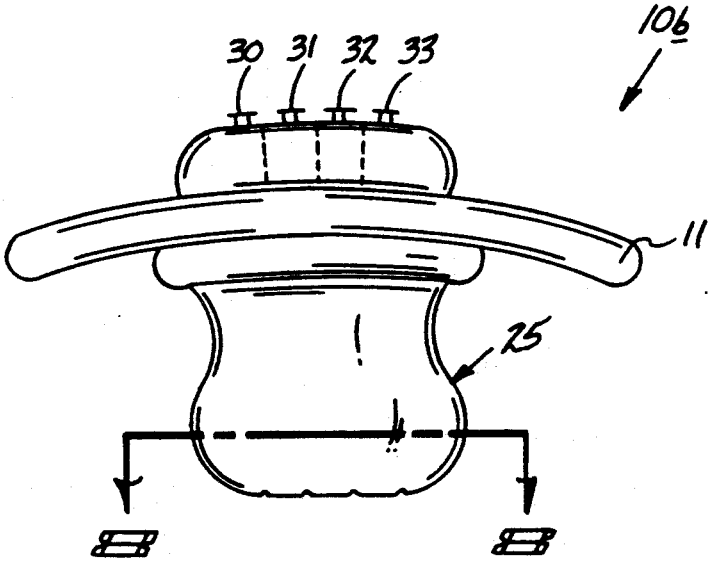
FIG. 7 is an orthographic view taken in elevation of a further modified application of the instant invention.
Figure 8:
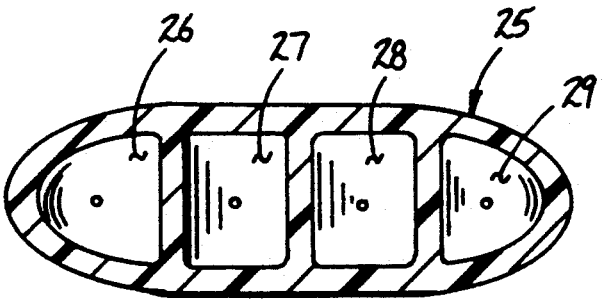
FIG. 8 is an orthographic cross-sectional view taken along the lines 813 8 of FIG. 7 in the direction indicated by the arrows.

FIG. 7 illustrates a further modified teething kit 7 wherein the arcuate base member 11 is formed with an elongate chambered nipple 25 formed with parallel discrete chambers defined by a first chamber 26, a second chamber 27, a third chamber 28, and a fourth chamber 29, each formed with its individual vent opening through a forward end of the nipple, with an individual fill plug defined by a first fill plug 30, a second fill plug 31, a third fill plug 32, and a fourth fill plug 33 to direct various fluids within the various side-by-side chambers formed within the chamber nipple 25. In this manner, various medicines may be directed into a discrete chamber, while various fluids are directed within other chambers to mask the associated medicine for consumption by an infant.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An infant rattle and teething kit comprising in combination, an arcuate base member, including a concave forward surface and a convex rear surface, and a generally elliptical nipple mounted orthogonally and medially of the forward surface, and a rear chamber mounted coaxially of the nipple on the rear surface of the arcuate base, and wherein the nipple includes a multi-compartmented nipple defined by discrete compartments mounted in a side-by-side relationship through the nipple, with at least one opening directed through a forward end of the nipple into each compartment, and the rear chamber including a plurality of fill compartments, each fill compartment in fluid communication with a compartment of the nipple to permit filling of each compartment with a discrete fluid therewithin, and each fill compartment including a fill plug directed through the rear chamber remotely oriented relative to the forward end to permit selective filling of each compartment.

* * * * *